United States Patent [19]

McLane

[11] 4,057,853

[45] Nov. 15, 1977

[54] SNAKE LEGGINGS

[76] Inventor: Larry A. McLane, Rte. 1, Box 49, Amaconda, Mont. 59711

[21] Appl. No.: 701,570

[22] Filed: July 1, 1976

[51] Int. Cl.[2] ..... A41D 13/00

[52] U.S. Cl. ..... 2/22

[58] Field of Search ..... 2/22; 36/1.5, 2 R, 77

[56] References Cited

U.S. PATENT DOCUMENTS

| | | | |
|---|---|---|---|
| 1,869,103 | 7/1932 | Janalik | 36/2 |
| 2,733,443 | 2/1956 | Holder | 2/22 |

FOREIGN PATENT DOCUMENTS

| | | | |
|---|---|---|---|
| 546,213 | 9/1957 | Canada | 2/22 |
| 2,310,149 | 9/1974 | Germany | 2/22 |

*Primary Examiner*—Werner H. Schroeder
*Assistant Examiner*—Doris L. Troutman

[57] ABSTRACT

A legging, for being worn by a person for protection against snake bites as well as bites from other objectionable animals; the leggings including a double mesh, close woven stainless steel, and having a vertical slit along a rear side so as to allow fitting a leg thereinto, the vertical slit being closable by interconnecting strips of resilient hook and loops fastening and straps, the knee portion of the legging having a pad for comfort, and the underside of the legging being open, and including sidewardly crossing straps for passing under a shoe or boot, the forward end of the legging having a rigid, nonpliable toe cap.

1 Claim, 6 Drawing Figures

Fig. 1
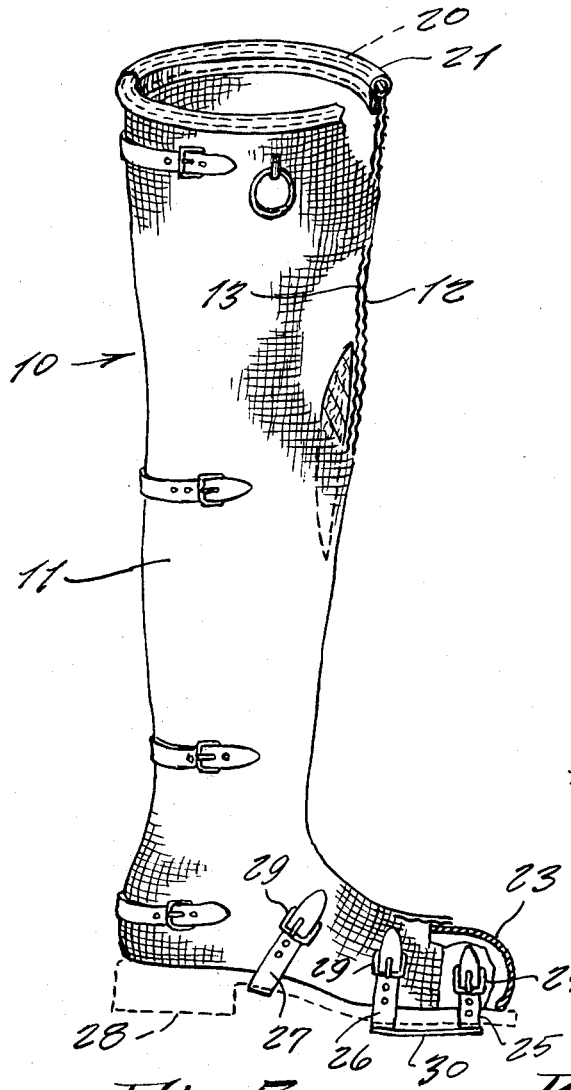
Fig. 2
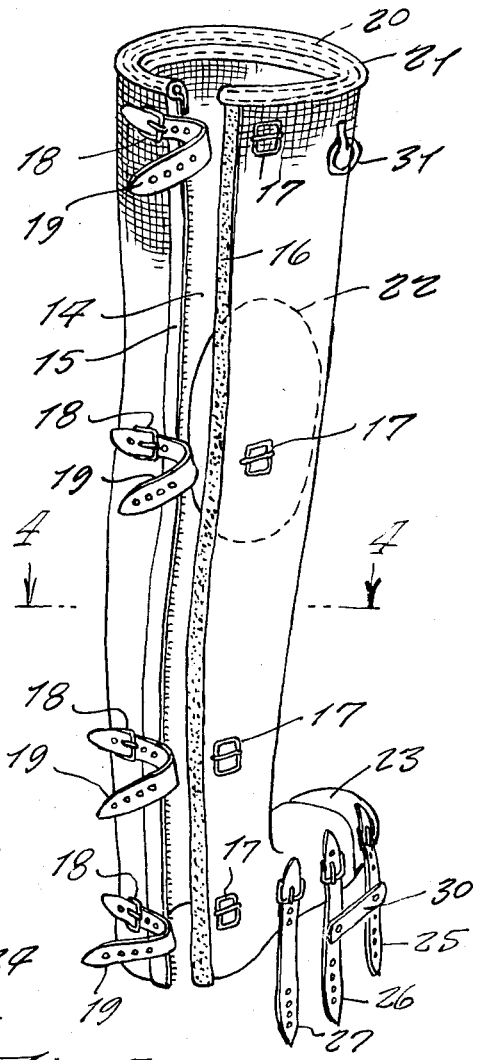
Fig. 3
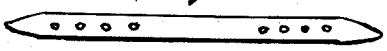
Fig. 4
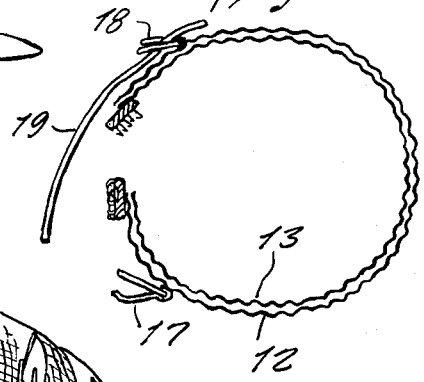
Fig. 6
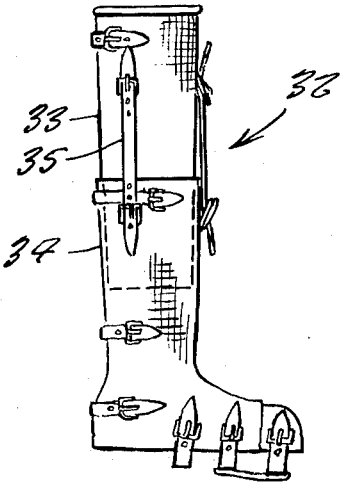
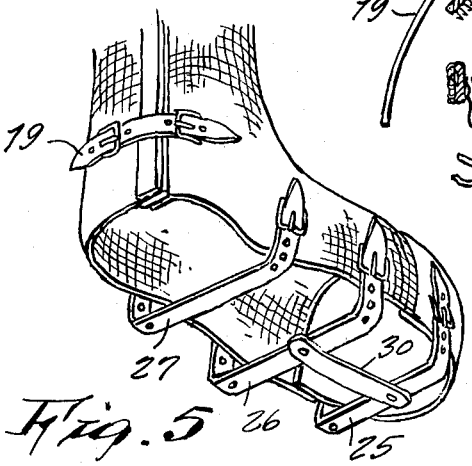
Fig. 5

SNAKE LEGGINGS

This invention relates generally to protective garments. More specifically, it relates to snake-proof garments, such as leggings.

A principal object of the present invention is to provide a legging that is designed to prevent snake bites, rabid small animals, scorpions and other pests such as wood ticks from biting a wearer's legs.

Another object of the present invention is to provide a legging, that is made of close woven, stainless steel mesh, which is doubled for protection, and which is thus ventilated, so as to be comfortable to a wearer.

Still another object is to provide a snake legging, which is rust proof, easy to put on, and which is bug tight.

Still a further object is to provide snake leggings, which include a knee pad, so as to prevent a person's knees from rubbing on the mesh, while walking, or while kneeling.

Other objects are to provide a snake legging, which is simple in design, inexpensive to manufacture, rugged in construction, easy to use and efficient in operation.

These and other objects will be readily evident upon a study of the following specification, and the accompanying drawing, wherein:

FIG. 1 is a side elevation view of the present invention, shown with portions broken away at several places, so as to illustrate the padded top ring, the knee cushion and the rigid toe cap;

FIG. 2 is a rear perspective view of the invention, shown opened up in order to allow insertion of a person's leg thereinto;

FIG. 3 is a view of one of the straps;

FIG. 4 is a cross-sectional view taken on line 4—4 of FIG. 2;

FIG. 5 is a bottom perspective view of the foot portion of the legging;

FIG. 6 is a side elevation view of a modified design of the invention, and which is adjustable in length.

Reference is now made to the drawing in greater detail, and more particularly to FIGS. 1 through 5 thereof at this time, wherein the reference numeral 10 represents a snake legging, according to the present invention, wherein there is a main body 11 of the legging, and which is made from close woven, stainless steel mesh, made up in a double layer, that comprises an outer layer of mesh 12, and an inner layer of mesh 13. The main body is shaped like a long stocking, and which, on its rear side, has a vertical split 14, so as to form an entry, into which a person's leg can be fitted, so as to put the legging on. This split or opening is closable by means of interconnecting strips of resilient hook and loops strips 15 and 16, along each side edge of the split, the strips being engageable together, so as to form a bug proof closure. Additionally, buckles 17 and 18, upon opposite sides of the split, each receive opposite ends of straps 19 so as to additionally secure the split in a closed position.

The upper edge 20 of the main body is crimped and embossed. A heavy padding 21 encloses the crimped and embossed edge 20, so as to be comfortable around a person's leg.

A lightweight knee pad 22 is fastened to the inner side of the legging, so as to prevent a person's knee cap from rubbing on the mesh, while walking or kneeling.

The forward end of the legging foot portion comprises a toe cap 23, that is made of rigid, non-pliable material, and which includes a buckle 24 on each opposite side, so as to receive opposite ends of a strap 25, that extends around the underside of a shoe or boot that is being worn inside the legging. Accordingly, it is to be noted that the underside of the toe cap is left open. Likewise, the remaining lower end of the legging is likewise left open, as is clearly evident in FIG. 5, and the foot portion of the legging is securable to a wearer by means of an instep strap 26, and an arch strap 27, which are passed around the underside of the boot or shoe 28, opposite ends of the straps 26 and 27 being securable in buckles 29, provided upon opposite sides of the foot portion. In order to prevent the toe strap 25 from slipping forwardly, an interconnecting strap 30 connects the toe strap 25 with the instep strap 26.

It is to be noted that there are fourteen buckles on each legging, and there are seven straps per each legging.

A brass ring 31 is secured near the upper end of the legging, and is provided for comfortably carrying the legging, when the legging is not being worn by a person. While being worn, the legging brass ring 31 can alternately be connected to a belt strap, if so preferred.

Thus, there is provided a snake legging of double mesh stainless steel, so as to prevent snakes, or rabid animals from biting therethrough, and wherein interconnecting strips of resilient hook and loops is employed, together with straps, for securing the legging to prevent bugs, such as ticks, to enter thereinto. If preferred, an effective bug repellent may be sprayed upon the legging, to prevent ticks and other bugs from climbing upwardly.

In FIG. 6, a modified design of snake legging 32 is adjustable in length for higher or lower protection, as needed, the legging consisting of telescopic upper and lower sections, 33 and 34, which are adjustably secured together by means of a plurality of straps 35.

While various changes may be made in the detail construction, it is understood that such changes will be within the spirit and scope of the present invention as is defined by the appended claims.

What I now claim is:

1. A snake legging, comprising in combination, a main body of double layer, close woven, stainless steel mesh, an upper edge of said legging being crimped and embossed, and enclosed within a heavy padding, a vertical side of said legging being split, forming adjacent vertical edgings which are closeable by engaging strips of resilient hooks and loops along each vertical edge and by a plurality of straps, a forward end of a foot portion of said legging comprising a toe cap made of rigid, non-pliable material, an underside of said foot portion being left open and including a plurality of crossing straps between opposite sides of said legging, and which straps extend under a shoe or boot of a wearer, said legging including means for higher or lower protection of a leg, as needed, and comprising said main body being made of an upper and a lower section, which telescopically interfit, and which are securable in selected, extended position by means of vertically interconnecting straps.

* * * * *